US005505990A

United States Patent [19]

Sagawa et al.

[11] Patent Number: 5,505,990

[45] Date of Patent: Apr. 9, 1996

[54] METHOD FOR FORMING A COATING USING POWDERS OF DIFFERENT FUSION POINTS

[75] Inventors: Masato Sagawa, Kyoto; Hiroshi Watanabe, Machida; Hiroshi Nagata, Kyoto, all of Japan

[73] Assignee: Intermetallics Co., Ltd., Kyoto, Japan

[21] Appl. No.: 264,753

[22] Filed: Jun. 23, 1994

Related U.S. Application Data

[63] Continuation of Ser. No. 102,898, Aug. 6, 1993, abandoned.

[30] Foreign Application Priority Data

Aug. 10, 1992 [JP] Japan ..... 4-232681
Mar. 9, 1993 [JP] Japan ..... 5-075248

[51] Int. Cl.[6] ..... B05D 3/12

[52] U.S. Cl. ..... 427/184; 427/195; 427/201; 427/202; 427/205; 427/214; 427/242; 427/375; 427/376.1; 427/383.1; 427/385.5; 427/404; 427/407.1; 427/419.2; 427/430.1; 427/601

[58] Field of Search ..... 427/184, 195, 427/201, 202, 205, 214, 242, 601, 375, 376.1, 383.1, 385.5, 404, 407.1, 419.2, 430.1

[56] References Cited

U.S. PATENT DOCUMENTS

| | | | |
|---|---|---|---|
| 2,334,112 | 11/1943 | MacKinney | 427/184 |
| 2,640,002 | 5/1953 | Clayton | 117/109 |
| 3,038,199 | 6/1962 | Bartow et al. | 18/5 |
| 3,093,501 | 6/1963 | Clayton | 117/29 |
| 3,189,667 | 6/1965 | Buttner et al. | 264/24 |
| 3,469,283 | 9/1969 | Vinson | 18/19 |
| 3,571,854 | 3/1971 | Lundstrom | 18/16.5 |
| 3,650,646 | 3/1975 | Kirkpatrick et al. | 425/78 |
| 3,897,532 | 7/1975 | Lyssy | 264/127 |
| 4,788,080 | 11/1988 | Hojo et al. | 427/202 |
| 4,808,224 | 2/1989 | Anderson et al. | 75/246 |
| 4,869,869 | 9/1989 | Anderson et al. | 419/44 |
| 5,080,731 | 12/1992 | Tabaru et al. | 148/103 |
| 5,250,255 | 10/1993 | Sagawa et al. | 419/39 |
| 5,273,782 | 12/1993 | Sagawa et al. | 427/242 |

FOREIGN PATENT DOCUMENTS

| | | |
|---|---|---|
| 20161854 | 11/1985 | European Pat. Off. . |
| 2386472 | 12/1990 | European Pat. Off. . |
| 49-135805 | 12/1974 | Japan . |
| 51-136198 | 5/1975 | Japan . |
| 55-26601 | 7/1980 | Japan . |
| 59-127823 | 7/1984 | Japan . |
| 60-112668 | 6/1985 | Japan . |
| 61-67599 | 4/1986 | Japan . |
| 61-114505 | 6/1986 | Japan . |
| 61-147997 | 7/1986 | Japan . |
| 61-194703 | 8/1986 | Japan . |
| 62-13298 | 1/1987 | Japan . |
| 62-64498 | 3/1987 | Japan . |
| 63-111155 | 5/1988 | Japan . |
| 63-227701 | 9/1988 | Japan . |

OTHER PUBLICATIONS

English abstract of Japanese Unexamined Patent Application (kokai) No. 56–119,699, published Sep. 19, 1981.

*Primary Examiner*—Bernard Pianalto
*Attorney, Agent, or Firm*—Fish & Richardson

[57] ABSTRACT

A method for forming a coating on at least one part to be coated has the steps of agitating a mixture including (i) the at least one part to be coated, (ii) a material that forms an adhesive layer on the at least one part to be coated, (iii) impact media, and (iv) multiple compositions of powder material; and fusing at least one of the multiple compositions of powder material.

25 Claims, 3 Drawing Sheets

METHOD FOR FORMING A COATING USING POWDERS OF DIFFERENT FUSION POINTS

This application is a continuation of U.S. application Ser. No. 08/102,898, filed Aug. 6, 1993, now abandoned.

FIELD OF THE INVENTION

This invention relates to methods for the formation of coatings on surfaces of parts used in various industrial fields.

BACKGROUND OF THE INVENTION

Methods for forming coatings on various kinds of parts have been applied in a wide variety of industrial applications. Coating the parts improves the surface performance of the parts and imparts various functions to the surfaces of the parts. In addition, coating is very important for improvement of appearance of parts and of the products which contain them. Therefore, coating techniques are required to have high reliability. Beside satisfying these requirements, reducing the costs of coating is an important object. These costs should be low enough that they do not account for a significant part of the production costs.

The following are examples of the major resin coating methods used currently:

(1) Electrodeposited plating—In this method, parts are dipped in a liquid in which a charged resin powder is suspended. Voltage from an outside power source is applied to the parts so that the charged powder is attracted thereto. Thus, the parts are coated with the resin powder. Subsequently, the resin powder is heated so that it becomes fused and/or crosslinked, thereby forming a strong, continuous coating on the parts.

(2) Electrostatic coating—In this method parts are subjected to the application of a voltage in a space in which a electrically charged resin powder is dispersed so that the resin powder is attracted to the parts, thereby forming a resin powder coating thereon. Subsequently, the coating is heated so that it becomes fused and/or crosslinked, and a strong and continuous coating is thus formed.

(3) Spray coating—In this method a resin is diluted with a solvent and sprayed on the parts to form a coating. Subsequently, the solvent is vaporized and the coating is fused and/or crosslinked.

(4) Dip painting—In this method parts are dipped in a resin liquid with a low viscosity, or a resin liquid in which the high viscosity is reduced by diluting with a solvent, so that the resin is deposited on the part surfaces. Subsequently, the deposited resin is fused and/or crosslinked so as to form a coating.

These conventional coating methods have the following problems:

(1) Electrodeposition coating:

(a) It is necessary to attach the parts to electrodes.

(b) The coating is not formed on the area to which the electrodes are attached. A "touch-up" process is necessary for such area to be coated, in which the part is covered with resin after the coating-formation. In both cases above, a lot of hand labor or the installation of robots which are capable of complex movements is required, which results in high surface treatment cost.

(c) In addition, used liquid from the electrodeposition coating process must usually be treated as industrial waste.

(2) Electrostatic coating:

This method involves the same problems as (a) and (b) for electrodeposition coating and further requires the use of large-scale equipment for dust-prevention and prevention of dust explosion, because powder scattering may cause dust explosion.

(3) Spray coating:

(a) Handling of the spray-guns requires considerable training and skill. Handling with robots may be possible, but a complex sequence of movements is required, which leads to high costs of coating.

(b) The film thickness tends to vary depending on the operation of the spray gun.

(c) The parts need to be turned over after spraying one side of the work piece so as to spray the other side.

(d) The resin has to be diluted with a large amount of solvent in order to spray. Pollution prevention techniques should be carried out during the evaporation of solvents after spraying.

(4) Dip painting—The dip painting method, in which a great number of parts can be plated simultaneously and in a short time, is most efficient and low in cost. It does not suffer from such problems as (a) and (b) of electrodeposition coating, or from such problems as (a) and (b) of spray coating. However, in this method, dripping and sagging of the liquid after the dipping are unavoidable. Or, in other cases, the liquid barely covers the parts or the liquid coverage is extremely thin in some regions. This method is therefore far less reliable as a coating method than the other methods discussed above.

SUMMARY OF THE INVENTION

It is an object of this invention to solve the problems of conventional resin coating methods. It is another object of this invention to provide a method for forming a coating on a part in which the constituent powder of the coating is compacted to a high density and the coating layer adheres firmly to the part, as well as to provide a coating method with high productivity and working efficiency with minimal environmental pollution.

The method of this invention involves taking a mixture of the parts to be coated, a material which forms an adhesive layer on the parts, a powder and media for coating formation and subjecting the mixture to vibration or stirring, thereby forming a coating on said parts. Subsequently, the powder in the coating is fused, as that term is defined below.

DETAILED DESCRIPTION OF THE INVENTION

Figure 1:
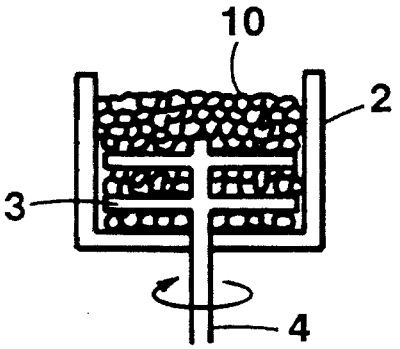
FIG. 1 illustrates stirring in accordance with this invention by using arms.

Examples of the invention are hereinafter described. However, it should be understood that the invention is not limited to these specific examples but can be varied as long as such variations are within the spirit and scope of the invention.

First, the characteristic features of the invention are described in the following sections (1) to (3):

(1) In the coating method of this invention, it is first necessary to form an adhesive layer on the part to be coated. The adhesive layer needs to have the degree of adhesiveness for the powder deposition mentioned later. The adhesive layer can be formed by using a resin in an uncured condition or other liquid or semi-liquid materials. However, preferred materials for the adhesive layer are such resins as epoxy resins and phenol resins in the uncured state, and various monomers. These materials for the adhesive layer should preferably harden with heating, but they may also be materials which do not necessarily harden with heating or materials that evaporate upon heating. When the surface of the part has been covered with a resin layer, the resin in the surface layer can be treated with a solvent so as to form an adhesive layer.

The adhesive layer can be formed by agitation (e.g., by applying vibration or stirring) the material simultaneously to form the adhesive layer together with the parts, the powder and the media mentioned later, but parts can be covered with an adhesive layer prior to the application of vibration or stirring. When an adhesive layer has preliminarily been formed on the part, agitation such as vibration or stirring is applied to the parts covered with the adhesive layer, the powder and the media. The thickness of the adhesive layer is determined according to the thickness of the coating to be formed, the powder used and the material of the media.

(2) The impact media (means for mediating the coating formation) which are vibrated or stirred together with parts, powder and material for forming an adhesive layer, or instead, together with a powder and parts covered with an adhesive layer are an important feature of this invention. The impact media strike the powder deposited on the adhesive layer of the part surface so as to press or push the powder into the adhesive layer, thereby bonding the powder more firmly with said adhesive layer. In addition, the impact media, by their impinging impact, squeeze the material forming the adhesive layer out upon the surface, and make the powder adhere to the squeezed-out material so that the powder is attached to the part surface in a multilayered and high densified state. Furthermore, due to the collision of the powder-covered media with the part, a kind of transference occurs in which the powder deposited on the media is transferred onto the part surface. This transference helps to cause the powder to firmly adhere to the part surface.

The powder deposition on the part surface stops, i.e., the coating formation stops, when the adhesive material is no longer squeezed out upon the surface despite impingement thereon by the media. In this transference, in which the powder deposited on the media is transferred to the part, many of the media particles uniformly strike the part surface so that the powder is uniformly applied to the part surface, thereby forming a homogeneous powder-containing layer. The part is therefore covered uniformly with the coating.

As described hereinabove, the media exert impinging impact, thereby mediating the coating formation. However, they do not become a substantial constituent of the coating.

It is also important for the impact medium to have a substantially smaller size than the part and a larger size than the powder particles. An impact medium larger than the part fails to impart a uniform impact to the part surface. On the other hand, if the medium is smaller than the powder particles, the medium itself is incorporated in the coating, which is not preferable. However, individual impact media particles larger than the part can be contained in the mass of media if the content is not more than 70% of the total media by volume.

Because pressure-bonding of the powder with the adhesive layer is promoted by concentrating the impinging impact with some intensity, the preferred diameter of a medium, when it is spherical, is 0.3 mm or more, and more preferably, 0.5 mm or more. The sizes of media with other shapes follow the same criteria. A medium smaller than a part means that the diameter of a medium, if the volume of a medium is converted into a sphere, is smaller than the longest width of the part. Regarding the relation between the powder and the media, desired impact can be obtained if the average size of the particles fulfills the requirement. That is, even when a part of media particles is finer than the powder particles, desired impact can be generated as long as the former is larger than the latter in average size. However, preferably the amount of such media particles smaller than the powder particles should be as little as possible because they are likely to be incorporated in the coating.

It is important for the material of the media to satisfy the following requirements:

(a) No change in shape due to plastic deformation so great as to be recognized with the naked eye is observed after formation of the coating. Furthermore, the elastic deformation of the medium during the coating process must not be extremely large. Therefore, for example, soft rubber is not a preferred material for the media.

(b) No cracks, fractures, or rapid wear occur, although some unavoidable wear due to long time use may occur.

If media consisting of a material which does not meet the above requirements plastically deform upon collision with the parts, or elastically deform to a significant degree as soft rubber does, the impact on the parts is too small to achieve the desired coating formation. Also, cracks and fractures or rapid wear shorten the life of the media, which is not preferable in terms of economy, productivity and operational efficiency.

As the coating-forming media, iron, steel alloys such as carbon steel, copper and copper alloys, aluminum and aluminum alloys and various other metals and alloys, or such ceramics as $Al_2O_3$, $SiO_2$, $TiO_2$, $ZrO_2$, SiC and the like, glass and hard plastics can be used. Hard rubber can also be used as long as it gives sufficient impact for coating formation. The size and material of the media can be selected according to the material of the powder to be used. Using a mixture of two or more kinds or sizes of materials is also possible. The media can be a mixture of several materials of different kinds and sizes. They can also be subjected to surface treatment or coating. The media can be a compound of several materials selected from the above mentioned materials.

In order to mitigate and homogenize the impact, soft media such as wood powder or sawdust, soft rubber or soft plastics may occasionally be mixed with the hard media, thereby forming a homogeneous coating without variation in thickness. Such soft media should preferably be 50% or less by volume of the total media.

Since such soft media materials generate little impinging force if used alone, they are always mixed with the hard media. The surfaces of such media may be coated with cured or uncured resin, or with a volatile liquid. Such coatings first help the powder evenly deposit on the media surfaces and then leave the media during mixing or stirring so as to adhere to the parts. Through this process, the powder is deposited more and more uniformly on the parts.

The configuration of the medium can be a sphere, ellipse, triangular pyramid, cylinder, cone, quadrilateral pyramid, rhombohedron, irregular shape and various other shapes.

(3) Another important feature of this invention is that parts covered with powder are, for example, to fuse the powder. Parts to which powder adheres are heated to fuse the powder so that the powder is at least partially fused, or if the powder is a mixture of different powders, at least one kind of the powders is fused, thereby preventing the powder from peeling off the coating; strengthening the bonding of the powder particles; filling pores in the coating with the fused material to form a high-densified coating with little pores; and smoothening the coating. As a result, various properties of the coating are improved, and a coating with high quality is obtained.

"Fusing" as defined for the purposes of this application is not necessarily "fusing" as defined in terms of chemistry or physics, but may involve heating to a temperature higher than the softening point of the powder as well as higher than the temperature at which the powder particles begin to coalesce with each other due to surface tension. It is not necessary for the entire powder to be fused. Only a portion of the powder in the vicinity of the surface needs to be fused for the particles to be mixed each other.

In general, a powder of materials with low fusion points is likely to be bonded directly by strong impact. If the coating method of this invention is carried out by using powders with low fusion points alone, the film grows thick in the portion of the part which is frequently subjected to the impact of the media and remains thin in the portion of the part which receives the impact less frequently. For example, if the part is ring-shaped, the difference in thickness is great between its inner surface and outer surface and between said parts, and the coating surface is very uneven.

A powder which is not fused under heating prevents such direct bonding of the powder particles, that is, not by the adhesive material added to the coating, and restricts unlimited growth of the coating by controlling the film thickness through use of a controlled amount of the adhesive material. Unevenness in film thickness is therefore less likely to occur, and its control becomes easier.

On the other hand, when a part is heated excessively in the heat treatment after the coating is formed, the viscosity of the fused powder becomes too low, which causes the fused, liquefied powder to drop or sag, and roughens the part surface.

Therefore, the powders which are not fused at the temperature at which other powders are fused should preferably be mixed with said other powders so as to prevent the fused and liquefied powder from dropping and sagging from the coating during heating, so as to form a more firmly structured coating. Such a powder which is not fused by heating functions as a structure stabilizer which prevents damage to the smoothness of the part surface and marks in its bottom by part holders such as a net holder. Also, such powder is distributed in the coating, thereby enhancing the strength of the coating.

As the powder which is not fused, inorganic pigments such as $TiO_2$ and red oxide used in various paints can be applied. These pigments exhibit their properties in the coating such as beauty and corrosion resistance. When the powder not fused by heating is a flat powder, the above mentioned effects due to the addition of the powder which is not fused are more preferably exhibited than when the powder is not flat.

As is described hereinabove, the features (1) to (3) of the invention set forth above are the important characteristics of this invention. An important factor in forming the coating of this invention is the powder, which is now described as follows:

It is important for the powder to be harder than the material, for example, an uncured resin, which forms the adhesive layer on the part surface, so that the powder can be pressed into the adhesive layer during the vibration or stirring, thus more firmly forming the coating. The powder to be used may be one kind or a mixture of two or more kinds of various resin powders, metal powders or inorganic materials. In addition, in order to be incorporated in the coating, the powder needs to be smaller than the media.

As the powder which is fused by heating, resin powders such as epoxy, acrylic and polyester, metals and inorganic powders with low fusion points can be used. Resin powders of the kind used in various paints may contain such inorganic pigments with high fusion points which are not fused by heating such as $TiO_2$ and red oxide. Such pigments exhibit their properties, e.g., beauty and corrosion resistance in the formed coating.

It is preferable for the powder which is not fused by heating to be flat before being subjected to vibration or stirring. However, powders such as aluminum and silver, which deform to be flat during vibration or stirring by the impact of the coating-forming media, can also be used. The term "flat" here refers to such shapes as discs, flat plates and bows which have substantially flat phases mainly constituting the powder structure. Preferably, the relation between the distance between opposed flat surfaces H and the average diameter (when converted into a circle having the same area) of the flat surfaces D should preferably be $H/D<1/2$, more preferably $H/D<1/4$ and most preferably, $H/D<1/6$.

The preferred flat powders not fused by the heating treatment are ground powders of aluminum, copper, silver, tin, zinc and their alloys. Since these metals are ductile, their flat surfaces are greatly extended by grinding. Therefore, they have conspicuous properties which promote uniform formation of the coating mentioned later. In addition, materials such as mica and BN which become flat by cleavage are preferred. The diameter of the flat powder D is preferably 300 μm or less. If it exceeds this, the uniformity of the film thickness may be affected. More preferably, D is 150 μm or less, and most preferably, 70 μm or less. The less the diameter D is, the better is the uniformity of the film thickness. However, the effect of the flat powder on the film thickness uniformity is weakened if D is too small. The preferred D of a flat powder is therefore 0.1 μm or more, and more preferably, 1 μm or more.

The desired grain size of the powder varies depending on the strength of the vibration or stirring, the size of the part, the thickness of the coating and the material of the powder. For powders such as ceramic powders which are too hard to deform, the grain size should preferably be small. For ductile metal powders, the grain size may be larger than this, but generally in the range from 0.01 to 500 μm. Preferably, it is in the range of from 0.01 to 300 μm, and more preferably, 0.01 to 100 μm. Generally speaking, the smaller the grain size, the more likely the powder is to be caught by the adhesive layer. In addition, particles with a small grain size are easily pressed by impinging force into the powder particles which are dispersed on the adhesive layer. Hence, such powder particles plastically deform so that they are easily bonded or pressure-bonded with each other or with the part. Therefore, the smaller the grain size, the smaller the requisite impinging force, as well as the smaller the surface roughness.

The proportion of the material for the adhesive layer, the media and the parts (hereinafter collectively referred to as the "coating forming mixture") to the whole coating forming mixture should be determined so as to be well-balanced as a whole and not to be partial to any one of them, so that each constituent fully exhibits its properties. The amounts of powder and the material for the adhesive layer are mostly determined according to the thickness of the coating to be applied to the parts and the total surface area of the parts. However, the mixing ratio of the powder and the material for the adhesive layer should preferably be determined so that the material for the adhesive layer is 0.5% or more when converted into the volume after curing. If the proportion of the adhesive material is below that, the deposition of the powder on the parts is insufficient. The mixing ratio of the media and parts, although depending on the shape of the parts, should be determined so that the proportion of the media is at least 50% or more, and preferably one to one by apparent volume. Otherwise, homogeneous and sufficient impingement upon the surfaces of the parts cannot be expected, which makes it difficult to obtain a good coating.

Alternatively to the above described method of applying vibration or stirring to the parts, it is possible to strike the parts with powder and the media, or the media on which powder is deposited, thereby attaching the powder to the parts to form a coating on their surfaces.

The above mentioned method is suitable for coating such parts as boxes and housing boxes having corners with which it is difficult to contact the coating-forming media by vibration or stirring. Preferably, powder should be deposited on the media. Then, powder and the powder deposited on the media are pressed by collision into the adhesive layer covering the parts, thereby forming a coating on the parts. The powder and media may be separately brought into collision with the parts. A gas stream and mechanical methods may be used to cause this collision.

Now, the above mentioned vibration and stirring are more specifically explained referring to the illustrations herein. It should be noted, however, that various methods other than the stated examples are possible for the vibration and stirring.

Figure 2:
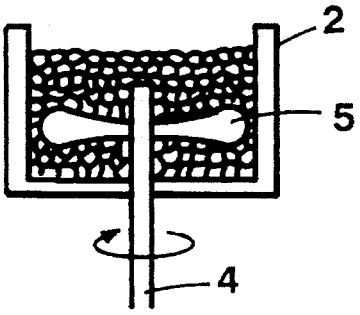
FIG. 2 illustrates stirring in accordance with this invention by using planes.

The vibration or stirring in a container can be carried out by the following various methods using:

arms 3 (FIG. 1) which are fixed to rotary shaft 4 provided in container 2;

planes 5 (FIG. 2) which are fixed to rotary shaft 4; or stirrer provided with impellers or blades (not shown).

The numeral 10 indicates the coating-forming media.

Figure 3:
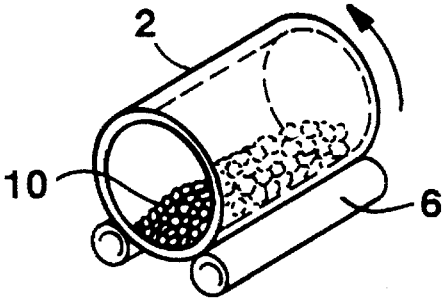
FIG. 3 illustrates stirring in accordance with this invention by rotation of a rotary container.
Figure 4:
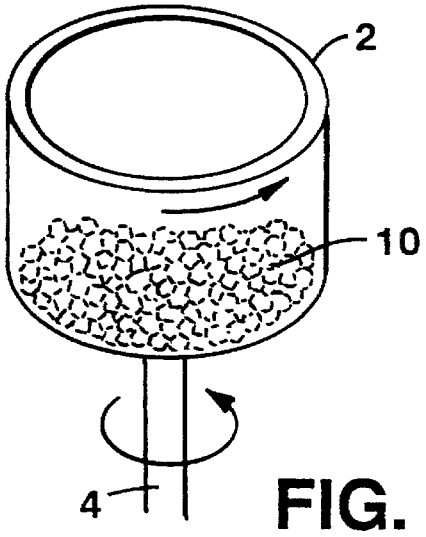
FIG. 4 illustrates stirring in accordance with this invention by rotation of a cylindrical container.
Figure 5:
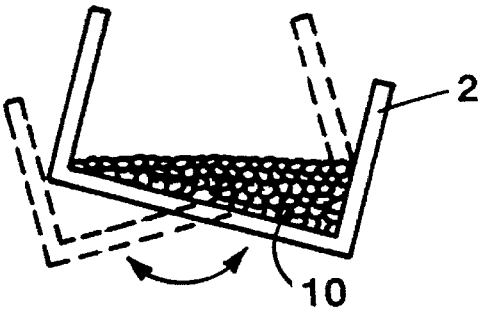
FIG. 5 illustrates stirring in accordance with this invention by rolling a cylindrical container.
Figure 6:
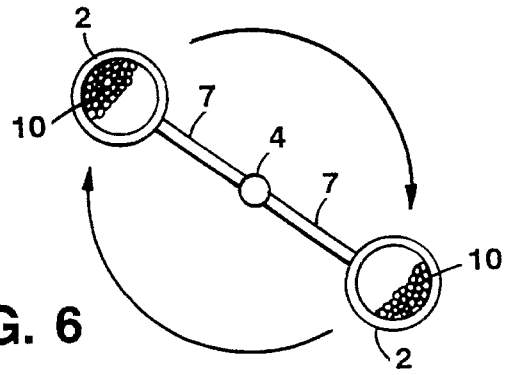
FIG. 6 illustrates stirring in accordance with this invention by rotating a container around the rotary axis.
Figure 7A:
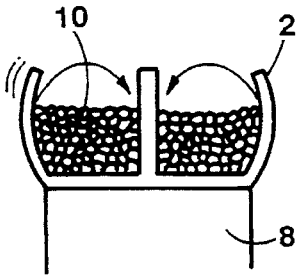
FIGS. 7*a* and *b* illustrates vibration in accordance with this invention by shaking a pot.
Figure 7B:
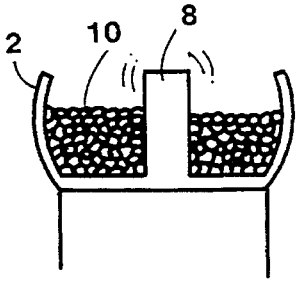

A drum or a pot container may be rotated on roller 6 as shown in FIG. 3. A drum container 2 fixed to the rotary shaft may be rotated as shown in FIG. 1. The container may be either open or sealed at the top. In addition, container 2 can be shaken as shown in FIG. 5. Stirring may be applied to the container during shaking. As shown in FIG. 6, it is possible to use the method in which the media are loaded in containers 2 secured to the ends of arms 7 which are symmetrically fixed to rotary shaft 4, and then the powder mixture is mixed by centrifugal force. In this case, the containers should preferably be rotated. As long as the movement of the container is substantially the same as above, the mechanism of rotation is not limited. For example, disc-shaped holders may be used as well. Alternatively, vibrator 8 provided inside or outside container 2 may impart vibration to the coating-forming mixture (FIGS. 7*a* and *b*). The vibrating or stirring condition may be in accordance with the usual conditions of commercially available vibrating barrels, centrifugal barrels and gyro barrels.

In order for the powder to be pressed and compacted in the adhesive layer at a high density, it is preferable to apply relatively small impinging impact uniformly to the part surface. The powder is therefore evenly compacted and pressed into the adhesive layer and does not leave the layer once it is incorporated. Hence, the density of the coating layer is high.

Figure 8:
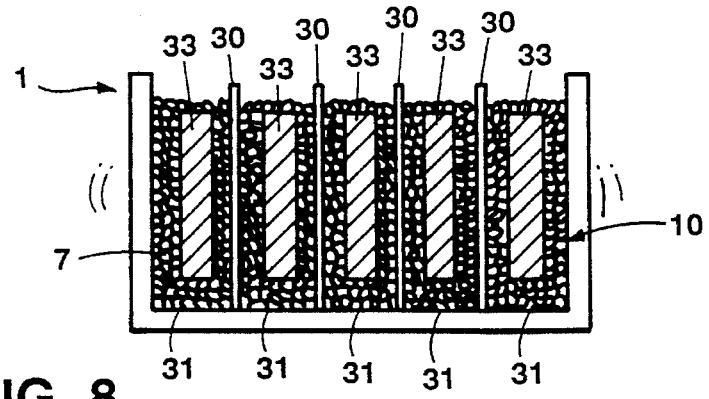
FIG. 8 illustrates an embodiment of the coating-formation method of this invention.
Figure 9:
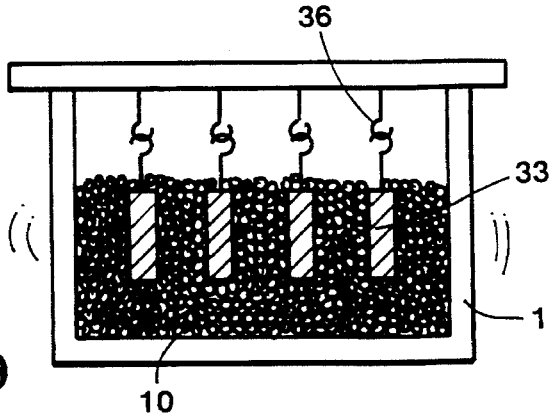
FIG. 9 illustrates an embodiment of the coating-formation method by suspending parts.

When coating relatively large numbers of parts or plates, as shown in FIG. 8, the container may be separated into several sections in each of which part 33 may be loaded and then subjected to vibration. Also, as shown in FIG. 9, parts 33 may be suspended in the container with hanging tools 36.

Figure 10:
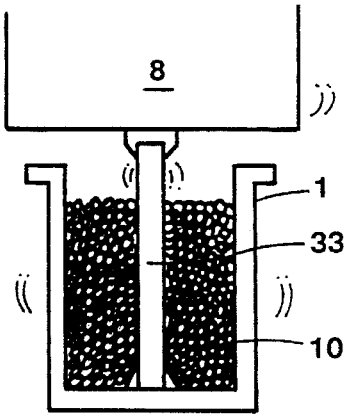
FIG. 10 illustrates an embodiment of the coating-formation method by applying vibration.
Figure 11:
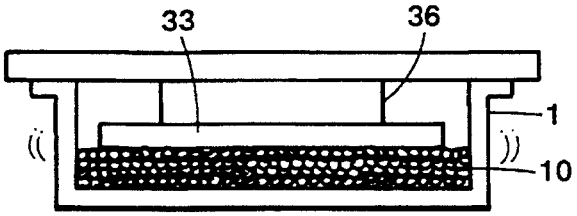
FIG. 11 illustrates an embodiment of the coating-formation method by suspending parts.

If wire meshes are used instead of partition plates 30 in FIG. 8, because the media can freely move in the container, the powder uniformly covers the parts, and as a result, a good and uniform coating can be obtained. It is also possible, as shown in FIG. 10, to secure part 33 inside container 1 and apply vibration to the container and/or to connect part 33 with vibrator 8 and apply vibration thereto. The method illustrated in FIG. 11 is also possible, in which part 33 is suspended in the container so that one side of the pare is in contact with the media, thereby coating only one side of the part by means of vibration.

When the part is a plastic housing box or the like, a solvent may be sprayed instead of resin so as to leach out the plastic from the workpiece, thereby forming an adhesive layer. In this method, the coating is formed only on the region onto which the solvent is sprayed. Therefore, it is quite easy by this method to coat, for example, only the interior of a housing box. There are cases in which the surface of the part cannot be thoroughly coated with one-time coating. In a method useful for such a case, the workpiece is separated into several parts, and after the desired region of each part is coated, the parts are assembled. For coating a large object such as an RF-shielded housing, the shielding may be carried out by enclosing the space with plates both of whose sides or one side are coated.

Figure 12:
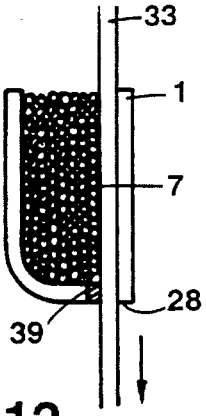
FIG. 12 illustrates an embodiment of the coating method for a plate.
Figure 13:
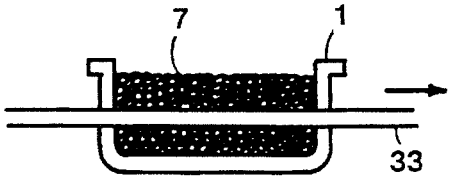
FIG. 13 illustrates an embodiment of the coating method for a plate.

In order for plain plates or long and slender wire rods to be coated, the method as illustrated in FIG. 12 is applied. A part 33, such as a plate, penetrates container 1 through hole 28 provided at the bottom of the container. The media are loaded into the container, and while vibration is applied, a material such as resin for forming the adhesive layer and a coating powder are continuously injected little by little. Part 33 is slid through packing 39, and drawn out of the container. Part 33 may be preliminarily coated with an adhesive layer and then loaded into container 1. In such a case, only the media 37 and powder are injected into container 1. It is possible to coat only one side of a plate as shown in FIG. 12, by attaching one side of the plate to the inside wall of the container. Or, as FIG. 13 illustrates, part 33 may be drawn out in the horizontal direction so that both sides of said part are coated.

Figure 14:
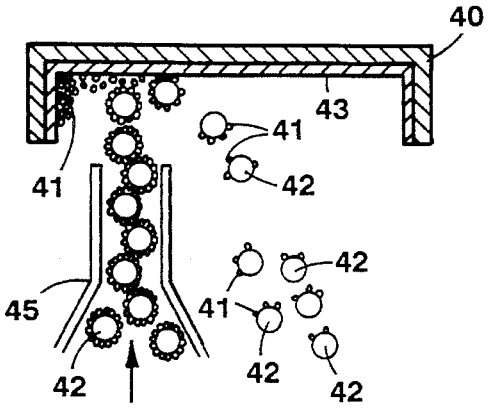
FIG. 14 illustrates an embodiment of the coating method for corners of a housing box.

Coating corners of a housing box by the methods described referring to FIG. 1 to 13 may sometimes be difficult. In such a case, powder is deposited on media such as the steel balls 42 shown in FIG. 14 on whose surfaces adhesive layers such as uncured resin layers have been previously formed. The media, steel balls 42, are then spouted out from nozzle 45. An adhesive layer such as an uncured resin layer has previously been formed on housing box 40. When steel balls 42 strike, or impinge, adhesive layer 43, powder 41 is caught by the adhesive layer and pushed therein by the steel balls. After powder 41 leaves steel balls 12, the balls fall and collision occurs in succession. Hence the powder is more and more pressed into adhesive layer 43, where it is compacted, densified and surface-contacted, thereby forming a coating.

Alternatively to the above method, powder 41 and steel balls 42 may be separately blasted toward the same spot. Blasting may be carried out mechanically or by using a gas stream. In particular, it is preferable for the corners to be chamfered so as to make easier forming a coating layer thereon. In general, chamfering is indicated by the radius of curvature, R. The preferred range of R is from 0.1 mm to 5 mm. More preferably it is 0.25 mm–3 mm, and the most preferred range is 0.5–2 mm.

In the methods in accordance with this invention, the vibration or stirring is not carried out on a batch basis but is performed continuously on conveying equipment such as a conveyer belt. Therefore, such processes as attaching each part to the electrodes and the touch-up process which are necessary in electrodeposition and electrostatic coating are not needed. Furthermore, neither such work as turning over each part after coating one side nor a large-scaled power source for applying voltage to parts is necessary.

Since vibration or stirring and heating are applied to form the coating, neither the trained operator's skill in spray-coating nor robots with high performance are necessary for this invention, and coatings with a uniform thickness and high reliability can be obtained. No liquid dripping or sagging occurs as in dip painting.

Since the vibration or stirring can be also carried out in a container, problems such as powder scattering, solvent evaporation and contamination of the working environment which occur with the electrodeposition method do not arise in this invention.

In addition, since the remaining powder and media can be reused, problems such as the waste-bath treatment which is necessary for electrodeposition coating do not arise.

EXAMPLE 1

10 kg of steel balls with a diameter of 2.0 mm on whose surfaces a black epoxy resin powder had been deposited at 2% by volume were loaded in a spherical pot 2.8 liter in volume and 150 mm in depth. Vibration of 3600 cpm and 1–5 mm in amplitude was applied to the container. Twenty rapid quenched ribbon Nd—Fe—B based bonded magnets having an inner diameter, outer diameter and thickness of 10 mm, 12 mm and 10 mm, respectively, and ten sintered electromagnetic soft iron pieces 20 mm×10 mm×15 mm in size were dipped in a 10% epoxy—MEK solution (a mixture consisting of 94% epoxy resin and 6% curing agent was diluted with the MEK solution to a concentration of 10%) so as to coat them with resin. The magnets and soft iron pieces so coated were loaded in the container and subjected to vibration for 10 minutes. After that, the samples were taken out and found to be covered with a black epoxy resin powder-compacted layer with an average thickness of 8 μm. This coating-formation process took 25 minutes.

The samples were then subjected to heat treatment at 170° C. for 10 minutes. On the surface of each sample, a 7 μm±0.5 μm thick resin layer was formed. No pinholes were observed in any sample. No rust was observed on any sample after the humidity cabinet test at 80° C. with 95% humidity for 1000 hours.

EXAMPLE 2

On the surfaces of Nd—Fe—B based sintered permanent magnets 20 mm×20 mm×5 mm in size, powder-compacted layers were formed using an epoxy resin powder, a white epoxy resin powder (containing a white pigment), a black epoxy resin powder (containing a black pigment), a green polyester resin powder (containing a green pigment) and a red acryl powder (containing a red pigment), whose average grain sizes were 10 μm, 40 μm, 3 μm, 15 μm and 1 μm, respectively. After the formation of the powder-compacted layer, heat treatment was carried out at 140° C.–180° C. for 30 minutes.

The powder-compacted layer was formed by the following process:

10 kg of steel balls with a diameter of 2 mm whose surfaces had been subjected to Ni-plating were loaded in a spherical pot 2.8 liter in volume and 150 mm in depth. While vibration of 3600 cpm and 0.5 mm–5 mm in amplitude was applied to the pot, 30 g of each of said various powders were loaded into the pot and vibrated for 10 minutes so as to thoroughly cover the surfaces of the steel balls with the powder. Subsequently, parts which had been covered with resin by dipping in a epoxy resin solution (10% resin diluted with MEK solution) were loaded in the pot. Vibration was applied for 15 minutes and then the parts were taken out.

As a result, coatings with an average thickness of 5 μm, 20 μm, 4 μm, 10 μm and 6 μm, respectively, were obtained.

The corrosion resistance of each sample was tested and compared with electrodeposition coatings with an average thickness of 30 μm (comparative example) and with electrostatic coatings with an average thickness of 40 μm (comparative example). Although the thickness of the coatings of the invention obtained in accordance with Example 1 was smaller than that of the comparative examples, coatings obtained in Example 1 of the present invention exhibited corrosion resistance as high as or higher than that of the comparative examples.

EXAMPLE 3

Steel balls with a diameter of 1.0 mm were coated with 10 μm thick Ni coatings and 5 μm thick epoxy resin coatings. Furthermore, 3 volume % of a white epoxy resin with an average grain size of 2 μm was deposited on them. Seven kg of the steel balls were loaded in a container with an opening of 500 mm×30 mm in dimension and 100 mm in depth and with a slit 500 mm×1.5 mm in dimension at the bottom.

While vibration of 5000 cpm and 1–5 mm in amplitude was applied to the container, a 498 mm wide and 1.0 mm thick steel plate used for automobiles was moved down at a speed of 20 mm/min. A heater was provided at the bottom of the container, below the exit of the slit, under which the steel plate was rolled up. As a result, a 10 μm± 0.2 μm thick coating was formed on the steel plate, and the speed of coating-formation was 1.2 m/h.

EXAMPLE 4

Two kg of ceramic balls 0.2 mm in diameter which had been subjected to Ni-coating were loaded in a spherical pot 2.8 liter in volume and 150 mm in depth. A MEK solution in which 10% epoxy resin was dissolved (containing 97% resin and 3% curing agent) was sprayed on the ceramic balls. Vibration was applied to the container for 10 minutes so as to thoroughly cover the surfaces of the ceramic balls with the resin. Subsequently, 25 g of a black epoxy resin powder with an average grain size of 10 μm was loaded and subjected to the same vibration for 20 minutes.

After that, the processed ceramic balls were loaded in a shot blasting machine and sprayed onto a steel plate for automobiles with a nozzle 3 mm in diameter at a pressure of 6 kg/cm$^2$ and from a distance of 10–60 cm for 30 minutes. Then, baking was carried out at 140° C. for 20 minutes from which a coating with an average thickness of 20 μm resulted.

EXAMPLE 5

Ceramic balls with a diameter of 2 mm were loaded up to about 80% of the depth of a spherical container 3 liters in volume and 150 mm in depth. A white uncured epoxy resin powder (which cures after it is fused at 120° C.–130° C.) with an average grain size of 2 μm (the same resin powder was used in the following examples and in the comparative examples) and a titania powder 0.8 μm in average grain size were mixed in the weight ratio of 6:4. 20 g of the mixture was loaded in the container and vibration of 100–1000 cpm and 0.2–5 mm in amplitude was applied thereto for 3 minutes so that the powder thoroughly covered the ceramic balls. For the vibrating machine, a barrel machine sold under the trademark VIBRO BARREL VM-10 230 W by K. K. Tipton Espo, was used, and for the vibration controller, an inverter power source and a slidac were used.

Ten Nd—Fe—B based rapid quenched bonded magnets with an outer diameter, inner diameter and a height of 22 mm, 20 mm and 10 mm, respectively and ten Nd—Fe—B based sintered magnets with the same dimensions of 30 mm, 20 mm and 1 mm, respectively, were dipped in a MEK solution in which 7% uncured epoxy resin containing 5% curing agent was dissolved. After the magnets were taken out, they were dried with hot air for 30 seconds, thereby forming an adhesive layer on each surface. The magnets with adhesive layer were successively loaded in the vibrating machine and subjected to vibration for 5 minutes, and then all twenty magnets were taken out. The magnets were heated on a fluorine-containing resin plate at 150° C. for 2 hours. The epoxy resin on their surfaces first melted followed by immediate hardening.

The resultant coatings were observed and the following results were verified:

(1) The film thickness was uniform, 30 μm±15 μm at both the inner and outer surfaces.

(2) The mark of contact between the bottom surface and the device which holds the parts during the melt-curing process was small.

(3) The surface hardness was 5 H (by pencil test).

The cross section of the coating was observed with SEM. The $TiO_2$ powder was not fused, but the epoxy resin powder was totally fused and then hardened.

The same process was carried out without mixing in the titania powder at all. The results were:

(1) The film thickness varied so much that it was 30–60 μm at the inner surface, while 40–80 μm at the outer surface.

(2) The contact mark between the bottom surface and the holder was clearly recognized. The tested ring-shaped magnets had burrs which were so large as to exceed the allowable range for motor parts and would have had to be removed when used.

The film hardness was 1 H–2 H. The contacting marks and burrs described above may not be considered serious problems for large parts. In the above examples, the coating in accordance with the present invention was applied directly on the parts. However, it is also possible to apply the coating method of this invention to parts which have preliminarily been coated by methods other than this invention, as well as to parts which have been previously subjected to the coating in accordance with the present invention.

EXAMPLE 6

Ceramic balls with a diameter of 2 mm were loaded up to about 80% of the depth of a spherical container 3 liters in volume and 150 mm deep. A white uncured epoxy resin powder having an average grain size of 2 μm, which is the same in the following Examples and Comparative Examples, was obtained by crushing a thermosetting resin powder paint for electrostatic painting (sold under the trademark TEODULE DM 752 - 002 white, by Kubo Takashi Paint K. K.), an epoxy resin powder, having a grain size of 50 μm. This resin powder was mixed with an aluminum foil powder sifted out through a 100 mesh sieve in a weight ratio of the resin powder to the aluminum powder of 9:1. 20 g of the mixed powder was put into the container and vibration of 1000 to 4000 cpm and 0.2 to 5 mm in amplitude was applied for 3 minutes so that the powder thoroughly covered the surfaces of the ceramic balls. For the vibrating machine, a barrel machine (sold under the trademark VIBRO BARREL M-10(230W) by K. K. Tipton Espo) was used, and for the vibration controller, an inverter power source and a slidac were used. As vibration was applied, Nd—Fe—B based rapid quenched bonded magnets with an outer diameter, inner diameter and a height of 22 mm, 20 mm and 10 mm, respectively, and Nd—Fe—B type sintered magnets with the same dimensions of 30 mm, 20 mm and 1 mm, respectively, were dipped in a MEK solution in which 10% uncured epoxy resin (a mixture of the product sold under the trademark EPICOTE, a bisphenol A epoxy resin, 1001-B-80 by Shell and a curing agent sold under the trademark EPICURE-UZI-2, 2-undecyle imidazole, mixed in a weight ratio of 10:1) was dissolved. The number of samples for both was ten. They were taken out and dried by hot air for 30 seconds, thereby forming an adhesive layer on each surface. Subsequently, the magnets covered with adhesive layers were loaded in the vibrating container and subjected to vibration for 5 minutes, and then taken out. When the magnets were heated on a fluorine-contained resin plate at 150° C. for 2 hours, the white epoxy resin powder melted and then began hardening (this treatment is hereinafter referred to as the "melt-curing treatment"). Also, the epoxy resin powder forming the adhesive layer was cured.

The following results were confirmed by observing the resultant coatings:

(1) The film thickness was uniform, 20 μm±3 μm on both the inner surface and the outer surface. The parts had no fluctuation in thickness, either.

(2) The mark of contact between the bottom surface and the plate during the melt-curing treatment was so small as to be hardly recognized by the naked eye.

(3) The surface hardness was 5 H (by the pencil test) .

The cross section was observed with SEM. The flat aluminum powder particles were buried almost parallel to the film surface.

COMPARATIVE EXAMPLE 1

As a comparative example, the same process as the above example was carried out without using aluminum foil powder at all. The results were:

(1) The film thickness of the inner surface was 30 μm–50 μm, and that of the outer surface was 50–100 μm, resulting in many variations.

(2) The surface was very uneven.

(3) The mark of contact between the bottom surface and the plate during the melt-curing treatment was significantly large. The tested ring-shaped magnets had burrs which were so large as to exceed the allowable range for motor parts, so they would have to be removed when used for such parts. The hardness of the films was from 3 H to 4 H.

COMPARATIVE EXAMPLE 2

For another comparative example, a titanium powder with a nearly spherical shape and an average grain size of 1 μm was mixed instead of the aluminum foil powder in a weight ratio to epoxy resin powder of 1:9. Then the same treatment was applied to the parts. The resultant films exhibited the following properties:

(1) The thickness was so varied that it was 30 μm±7 μm at the inner surface, while being 40 μm±10 μm at the outer surface.

(2) Although the unevenness of the surface was improved as compared with the case of no powder addition (using only resin powder), it was still greater than when aluminum foil powder was added.

(3) The contact mark between the bottom surface and the plate during the melt-curing treatment was of about a middle degree between Example 1 and Comparative Example 1. The film hardness was 5 H.

EXAMPLE 7

Ceramic balls with a diameter of 2 mm were loaded up to about 80% of the depth of a spherical container 3 liters in volume and 150 mm deep. A white epoxy resin powder (uncured and having an average grain size of 2 μm) and a gold mica powder (shifted out through a 400 mesh sieve) whose surface had been subjected to a coupling treatment were mixed in a weight ratio of 8:2. 20 g of the mixed powder were loaded in the container. Vibration of 1000–4000 cpm and 0.2–5 mm in amplitude was applied to the container for 3 minutes so that the powder thoroughly covers the surfaces of the ceramic balls.

For the vibrating machine, a barrel machine (sold under the trademark VIBRO BARREL M-10(230W), produced by K. K. Tipton Espo) was used, and for the vibration controller, an inverter power source and a slidac were used.

Ten Nd—Fe—B based rapid quenched bonded magnets with an outer diameter, inner diameter and a height of 22 mm, 20 mm and 10 mm, respectively, and ten Nd—Fe—B based sintered magnets with the same dimensions of 30 mm, 20 mm and 1 mm, respectively, were dipped in a MEK solution in which 7% uncured epoxy resin was dissolved. Then they were taken out and dried by hot air for 30 seconds, thereby forming an adhesive layer on each surface. Subsequently, the magnets covered with adhesive layers were successively loaded in the vibrating machine and subjected to vibration for 10 minutes, and then all twenty samples were taken out. The magnets were subjected to the melt-curing treatment on the fluorine-containing resin net at 130° C. for 3 hours.

The following results were confirmed by observing the resultant coatings:

(1) The film thickness was uniform, 25 μm±3 μm at both the inner and outer surfaces. The parts had no fluctuation in thickness, either.

(2) The mark of contact between the bottom surface and the plate during the melt-curing treatment could hardly be recognized.

(3) The surface hardness was 5 H (by the pencil test).

The cross section was observed with SEM. The flat gold mica powder particles were buried almost parallel to the film surface.

COMPARATIVE EXAMPLE 3

For the comparative example, the same process was carried out without using the gold mica powder at all. The results were:

(1) The thickness was so varied that it was 35 μm–55 μm at the inner surface, while being 50 μm–100 μm at the outer surface.

(2) The film surface was very uneven.

(3) Large contact marks due to the melt-curing treatment were observed between the bottom surface and the plate. The film hardness was 3 H to 4 H.

COMPARATIVE EXAMPLE 4

For another comparative example, a titanium powder with a nearly spherical shape and an average grain size of 0.8 μm was mixed instead of the gold mica powder in a weight ratio to epoxy resin powder of 2:8. Then the same treatment was applied to the parts. The results were:

(1) The thickness was so varied that it was 35 μm±7 μm at the inner surface, while being 15 μm±10 μm at the outer surface.

(2) Although the unevenness of the surface was improved as compared with the case of no powder addition (using only resin powder), it was still greater than when gold mica powder was added.

(3) The contact mark between the bottom surface and the plate during the melt-curing treatment was recognizable to some extent. The film hardness was 5 H.

EXAMPLE 8

One hundred Nd—Fe—B sintered magnets 20 mm in diameter and 1.5 mm thick were prepared. These magnets were separated into groups A to D, each of which consisted of twenty parts. Ceramic balls 2 mm in diameter and 20 g of aluminum foil powder with an average grain size of 3 μm were loaded in a spherical container 3 liters in volume and 150 mm in depth and vibration of 3000–1000 cpm and 0.5–2 mm in amplitude was applied to the container for 5 minutes by using the same barrel machine as in Example 6 so that the ceramic balls were thoroughly covered with the aluminum foil powder.

The samples of A–D were dipped in a 5% epoxy-MEK solution and then dried so as to form adhesive layers thereon. So processed samples A–D were loaded in the vibrating container, and vibrated for 10 minutes, forming uncured coating layers in which aluminum powder was laminated. The samples of each group were subjected to the following different treatments:

Samples A:

First, they were subjected to curing at 150° C. for 2 hours. As a result, coating layers in which the aluminum foil powder was firmly adhered to the magnets were formed. These magnets were again dipped in a 5% epoxy-MEK solution and dried to form adhesive layers on the aluminum foil-coatings. The samples were loaded in another container of the same size as the one above. Ceramic balls 1 mm in diameter had been previously loaded in the container together with 25 g of white epoxy resin powder and 2.5 g of aluminum foil powder well mixed together. Vibration of 3000–4000 cpm and 1–10 in amplitude was applied to the container for 15 minutes. Then the samples were taken out and the epoxy resin powder deposited during the second coating formation was subjected to the melt-curing treatment at 130° C. for 2 hours. Consequently, a dual-layer coating comprising a 8 μm coating in which the aluminum foil powder was laminated and a 15 μm coating in which the aluminum foil powder and the epoxy resin powder were mixed was obtained.

Samples B:

The samples were not subjected to curing. They were dipped in a 10% epoxy-MEK solution and dried, thereby forming an adhesive layer thereon. The samples were loaded in a container of the same size as the container used for Samples A. Ceramic balls 2 mm in diameter had been previously loaded in the container together with 30 g of a epoxy-polyester resin powder with an average grain size of 2 μm, which was obtained by crushing a powder for electrostatic coating 50 μm in average grain size (for example, the product sold under the trademark E 350 ARON powder produced by Toa Gosei Kagaku K. K.), and 3 g of aluminum foil powder well mixed together. Subsequently, vibration of 3000–4000 cpm and 0.5–1 mm in amplitude was applied to the container for 5 minutes. In the final step, the melt-curing treatment was carried out at 150° C. for one hour. As a result, a dual-layer coating comprising a 8 μm thick coating in which the aluminum foil powder was laminated and a 12 μm thick coating in which the aluminum foil powder and epoxy-polyester resin were mixed was attained.

Samples C:

The same melt-curing treatment as for samples A was carried out at 130° C. for one hour. The samples were loaded in a vibrating container (the same as the one used for the sample B) without being covered with adhesive layers. Vibration was applied for 10 minutes. In the container, 30 of epoxy-polyester powder had been previously mixed with ceramic balls which were the same as those used for samples B. In the last step, melt-curing treatment was carried out at 160° C. for 2 hours. A dual-layer coating comprising a 8 μm thick coating in which the aluminum foil powder was laminated, and a 8 μm thick epoxy-polyester resin coating was formed on every sample.

Samples D:

The samples were not cured nor were adhesive layers formed thereon. The samples were loaded in the same container as used for samples B (the ceramic balls and the powder were the same as those for samples B). Vibration was applied for 8 minutes. Then the samples were taken out, followed by melt-curing treatment at 160° C. for 2 hours. The resultant coating was a dual-layer coating comprising a 8 μm thick coating in which the aluminum foil powder was laminated, and a 7 μm thick epoxy-polyester coating.

Samples E:

As comparative samples, samples E were spray-coated with epoxy-polyester paint containing a white pigment to have an average thickness of 25 μm. In the appearance test for samples A to D, the surface roughness of A was smaller than those of C and D. A had a high uniformity in film thickness and a high adhesion degree, which was the best of all samples. Samples A to D were subjected to the corrosion resistance test at 80° C. and under 95% humidity. As a result, samples A through D did not incur any rust or swelling. However, rust spots were recognized on Samples E after 200 hours, and swelling was observed after 500 hours.

By bringing the parts covered with an adhesive layer into contact with the powder and the powder-deposited media, and by striking the parts to which the powder adheres with the powder-deposited media, the powder is highly densified and firmly adheres to the parts. Meanwhile, due to the impingement by the media upon the powder, the material constituting the adhesive layer on the part is squeezed out and the powder therefore further adheres to the adhesive material, thereby forming a multilayered, strong powder coating. By heating the coating to fuse the powder, the powder particles are bonded with each other. Hence, peeling of the powder is prevented and pores in the film are reduced, by which the strength and smoothness of the coating is enhanced.

What is claimed is:

1. A method for forming a coating on at least one part to be coated, said method comprising the steps of:

agitating a mixture comprising (i) the at least one part to be coated, (ii) an adhesive material, (iii) impact media, and (iv) a plurality of compositions of powder material, to deposit a coating layer on the at least one part to be coated, the coating layer comprising the adhesive material and at least a portion of the plurality of compositions of powder material; and fusing at least one of the plurality of compositions of powder material.

2. A method according to claim 1, wherein at least another one of the plurality of compositions of powder material remains unfused after said fusing step.

3. A method according to claim 2, wherein the at least another one of the plurality of compositions of powder material that remains unfused after said fusing step comprises flat particles.

4. A method according to claim 1, wherein the plurality of compositions of powder material comprises a first composition of powder material and a second composition of powder material, such that the second composition has a higher fusion point than the first composition.

5. A method according to claim 4, wherein said fusing step occurs at a point higher than the fusion point of the first composition and lower than the fusion point of the second composition.

6. A method according to claim 1, wherein said fusing step comprises heating the plurality of compositions of powder material to a temperature high enough to fuse at least one of the plurality of compositions of powder material.

7. A method according to claim 1, wherein said agitating step comprises stirring the mixture.

8. A method according to claim 1, wherein said agitating step comprises vibrating the mixture.

9. A method according to claim 1, wherein said agitating distributes at least a portion of the plurality of compositions of powder material throughout the adhesive material to form the coating layer.

10. A method for forming a coating on at least one part to be coated, said method comprising the steps of:

adhering an adhesive material to the at least one part to be coated;

agitating a mixture comprising (i) the at least one part to be coated on which the adhesive material was adhered, (ii) impact media, and (iii) a plurality of compositions of powder material, to form a coating layer on the at least one part to be coated, the coating layer comprising the adhesive material and at least a portion of the plurality of compositions of powder material; and fusing at least one of the plurality of compositions of powder material.

11. A method according to claim 10, wherein at least another one of the plurality of compositions of powder material remains unfused after said fusing step.

12. A method according to claim 11, wherein the at least another one of the plurality of compositions of powder material that remains unfused after said fusing step comprises flat particles.

13. A method according to claim 10, wherein the plurality of compositions of powder material comprises a first composition of powder material and a second composition of powder material, such that the second composition has a higher fusion point than the first composition.

14. A method according to claim 13, wherein said fusing step occurs at a point higher than the fusion point of the first composition and lower than the fusion point of the second composition.

15. A method according to claim 10, wherein said fusing step comprises heating the plurality of compositions of powder material to a temperature high enough to fuse at least one of the plurality of compositions of powder material.

16. A method according to claim 10, wherein said agitating step comprises stirring the mixture.

17. A method according to claim 10, wherein said agitating step comprises vibrating the mixture.

18. A method according to claim 10, wherein said agitating distributes at least a portion of the plurality of compositions of powder material throughout the adhesive material to form the coating layer.

19. A method for forming a coating on at least one part to be coated, said method comprising the steps of:

adhering an adhesive material to the at least one part to be coated;

striking the at least one part to be coated on which the adhesive material was adhered with impact media that are covered with a plurality of compositions of powder material to form a coating layer on the at least one part to be coated, the coating layer comprising the adhesive material and at least a portion of the plurality of compositions of powder material; and fusing at least one of the plurality of compositions of powder material deposited on the at least one part to be coated.

20. A method according to claim 19, wherein at least another one of the plurality of compositions of powder material remains unfused after said fusing step.

21. A method according to claim 20, wherein the at least another one of the plurality of compositions of powder material that remains unfused after said fusing step comprises flat particles.

22. A method according to claim 19, wherein the plurality of compositions of powder material comprises a first composition of powder material and a second composition of powder material, such that the second composition has a higher fusion point than the first composition.

23. A method according to claim 22, wherein said fusing step occurs at a point higher than the fusion point of the first composition and lower than the fusion point of the second composition.

24. A method according to claim 19, wherein said fusing step comprises heating the plurality of compositions of powder material to a temperature high enough to fuse at least one of the plurality of compositions of powder material.

25. A method according to claim 19, wherein said striking distributes at least a portion of the plurality of compositions of powder material throughout the adhesive material to form a coating layer.

* * * * *